US006127901A

United States Patent [19]

Lynch

[11] Patent Number: 6,127,901

[45] Date of Patent: Oct. 3, 2000

[54] METHOD AND APPARATUS FOR COUPLING A MICROSTRIP TRANSMISSION LINE TO A WAVEGUIDE TRANSMISSION LINE FOR MICROWAVE OR MILLIMETER-WAVE FREQUENCY RANGE TRANSMISSION

[75] Inventor: Jonathan J. Lynch, Oxnard, Calif.

[73] Assignee: HRL Laboratories, LLC, Malibu, Calif.

[21] Appl. No.: 09/322,119

[22] Filed: May 27, 1999

[51] Int. Cl.[7] ..... H01P 8/107

[52] U.S. Cl. ..... 333/26; 333/33

[58] Field of Search ..... 333/21 R, 26, 333/33; 343/859

[56] References Cited

U.S. PATENT DOCUMENTS 4,679,249 7/1987 Tanaka et al. ..... 333/26 X 5,793,263 8/1998 Pozar ..... 333/26

*Primary Examiner*—Paul Gensler

*Attorney, Agent, or Firm*—Ladas & Parry

[57] ABSTRACT

A microstrip transmission line to waveguide transmission line transition. A microstrip transmission line is separated from a ground plane by a dielectric therebetween. The microstrip transmission line terminates at a microstrip transmission line open circuit end. A waveguide channel having narrow dimension waveguide walls and a broad dimension base waveguide wall connected therebetween is provided. The waveguide channel has a waveguide short circuit wall located along the channel. The narrow dimension waveguide walls are coupled with the ground plane to provide a broad dimension top waveguide wall for the waveguide transmission line. An aperture is located transverse to the microstrip transmission line and passes through an aperture ground plane opening in the ground plane. The aperture is located proximate to the microstrip transmission line open circuit end to provide a microstrip transmission line open circuit stub and proximate to the waveguide short circuit wall to provide a waveguide transmission line short circuit stub.

14 Claims, 5 Drawing Sheets

METHOD AND APPARATUS FOR COUPLING A MICROSTRIP TRANSMISSION LINE TO A WAVEGUIDE TRANSMISSION LINE FOR MICROWAVE OR MILLIMETER-WAVE FREQUENCY RANGE TRANSMISSION

FIELD OF THE INVENTION

This invention relates to the field of microwave or millimeter wave energy transmission, and, more particularly, to a method and apparatus for coupling transmitted microwave or millimeter wave energy from a microstrip transmission line to a waveguide transmission line in a structure that is well suited to very low cost mass production.

BACKGROUND OF THE INVENTION

In the field of microwave and millimeter wave energy transmission, such as commercial automotive radar systems (e.g. DE/Delphi's 77 GHz Forward Looking Radar), a myriad of microwave or millimeter wave components are involved, including millimeter integrated circuits (MMICs), diodes, printed circuits, antennas, and possibly waveguide components such as voltage-controlled oscillators (VCOs) and isolators. Most of the components utilized are typically mounted on planar microstrip transmission line circuits since this method is extremely low cost. However some components, such as antennas, may be more preferably compatible with waveguide transmission lines instead of microstrip transmission lines. Therefore, when microstrip transmission lines are used in conjunction with waveguide transmission lines, there is a need for an effective way to transfer transmitted wave energy between the microstrip transmission line and the waveguide transmission line without serious return loss and insertion loss degradation.

One method of designing microstrip to waveguide transitions is to use probes to couple energy to and from the waveguide. However, at very high frequencies (such as 77 GHz) probes are very tiny and difficult to handle in a high volume manufacturing environment. Manufacturing tolerance errors can cause serious return loss and insertion loss degradation.

For example, one prior art coupling technique is known as a probe launch. A circuit board (e.g., a DUROID™ board) is cut back so that a tab having a microstrip transmission line which runs to the end of the tab, is inserted into the waveguide. The typical circuit board ground plane is cut away below the microstrip transmission line protruding into the waveguide so that the insulator portion of the board supports the "stick out" tab portion of the microstrip transmission line as a probe. The cutaway circuit board is placed into a waveguide opening, thereby creating a probe launch into the waveguide. However, the difficulty with such an approach is the ability to manufacture and assemble the components in a high volume manufacturing environment. It is somewhat difficult to cut the circuit board to make the microstrip probe and then slip the cut board into the waveguide structure such that there is good contact between the ground of the circuit board and the waveguide wall. Also, it should be noted that the waveguide opening where the circuit board is inserted must be carefully controlled so that the probe does not short circuit against the waveguide wall. As such, those skilled in the art can appreciate that the whole manufacturing and assembly procedure involved with providing a mechanically and electrically stable microstrip probe end launch is not straightforward.

Another similar probe launch technique also involves a microstrip transmission line on a circuit board (e.g. a DUROID™ board), where at an end point along the microstrip transmission line there are a series of vias in a rectangular pattern around the end point and through the circuit board and connecting with the typical circuit board ground plane. The rectangular pattern of vias conduct all the way to the ground plane. A waveguide back short then connects with the vias at the ground plane and waveguide walls are formed perpendicular to the duroid board at the end point so that a microstrip to waveguide transition is formed. This approach allows such end launching to be formed in the middle of a board rather than at the end as described previously with the cut board and "stick out" tab probe. This approach also requires having a sizeable opening in the waveguide which can produce unwanted leakage radiation. While this latter approach may be somewhat simpler to accomplish than the former cut board approach, similar manufacturing control problems as previously described still exist.

There is therefore still a need for an efficient, cost effective method and apparatus for coupling microwave or millimeter wave frequency range energy from a microstrip transmission line to a waveguide transmission line. The present invention provides such a microstrip to waveguide transition whose simple assembly makes it ideal for high volume manufacturing.

SUMMARY OF THE INVENTION

In accordance with the present invention a method and apparatus for coupling a microstrip transmission line to a waveguide transmission line for a microwave or millimeter-wave frequency range is provided. A microstrip transmission line is separated from a ground plane by a dielectric therebetween. The microstrip transmission line terminates at a microstrip transmission line open circuit end. A waveguide channel having narrow dimension waveguide walls and a broad dimension base waveguide wall connected therebetween is provided. The waveguide channel has a waveguide short circuit wall located along the channel. The narrow dimension waveguide walls are coupled with the ground plane to provide a broad dimension top waveguide wall for the waveguide transmission line. An aperture is located transverse to the microstrip transmission line and forms an aperture ground plane opening in the ground plane. The aperture is located proximate to the microstrip transmission line open circuit end to provide a microstrip transmission line open circuit stub. The aperture is also located proximate to the waveguide short circuit wall to provide a waveguide transmission line short circuit stub. In a preferred embodiment a microstrip transmission line substrate is bonded to a conductive block using a conductive adhesive. The conductive block has a channel which forms three of the four waveguide transmission line walls. The ground plane of the microstrip substrate forms the upper waveguide transmission line wall. Transmitted wave energy is coupled between the microstrip transmission line and the waveguide transmission through the aperture etched in the microstrip ground plane of the substrate. The aperture is located less than a quarter-wavelength at the operating center frequency from the microstrip transmission line open circuit end and less than a quarter-wavelength at the operating center frequency from the waveguide short circuit wall.

DETAILED DESCRIPTION

Figure 1:
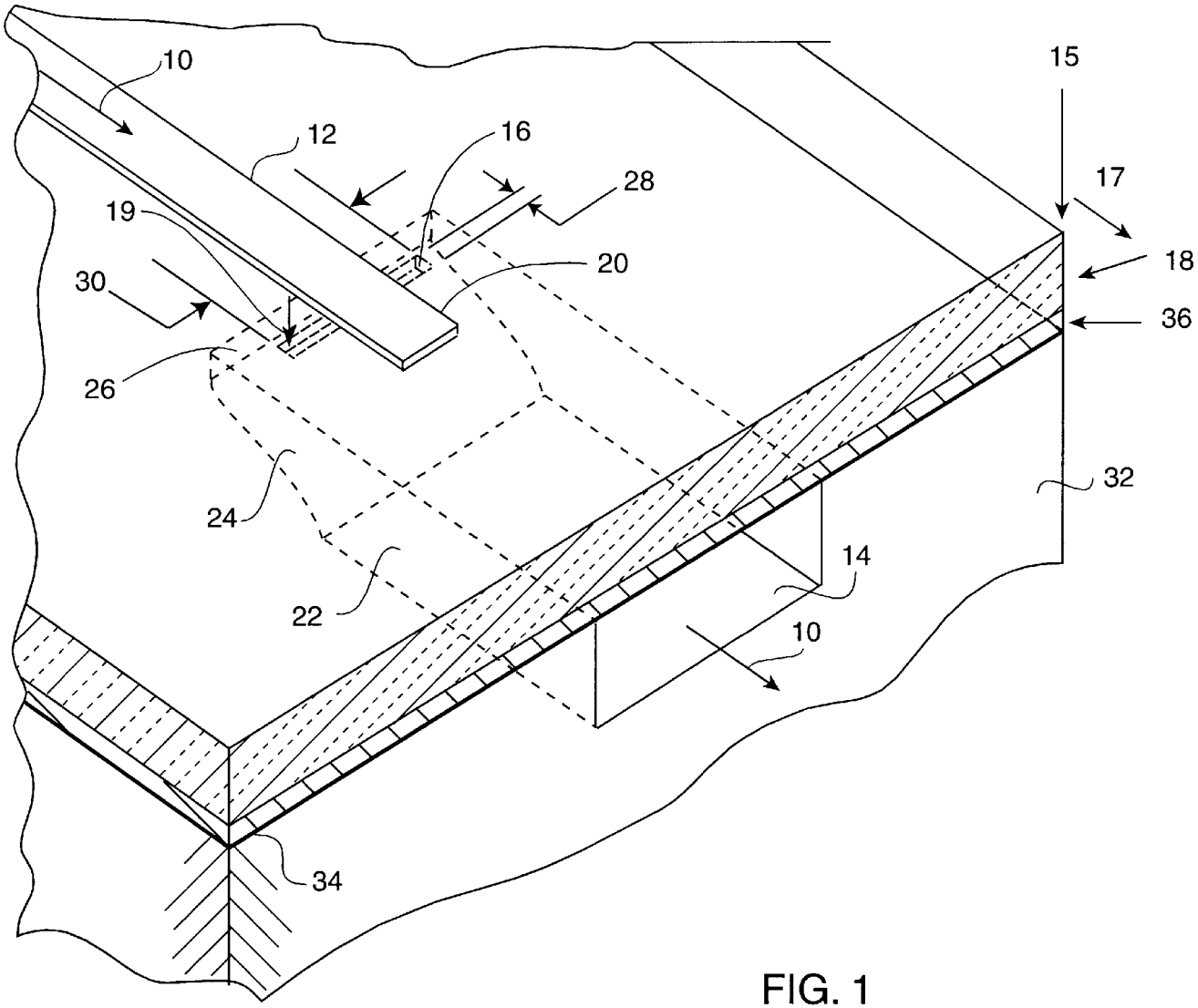
FIG. 1 shows a perspective schematic view of an embodiment of the invention.
Figure 2A:
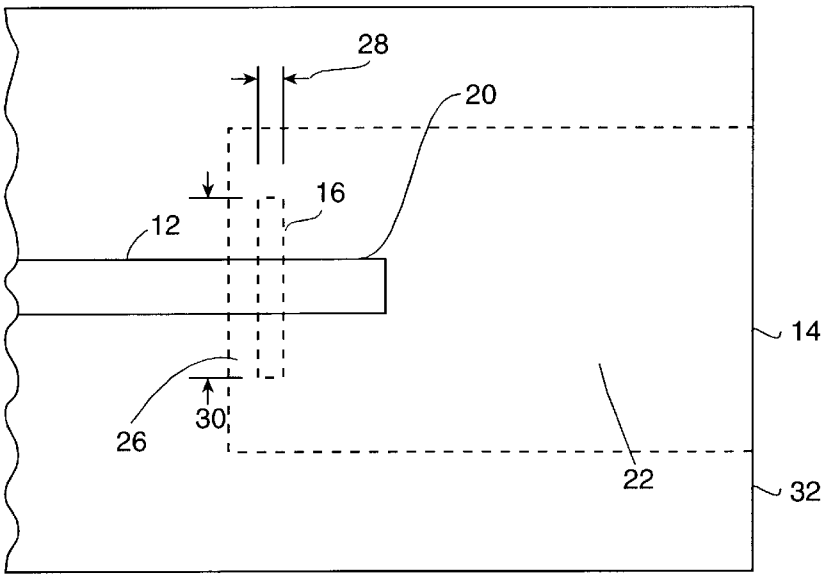
FIG. 2A is a top plan view of the embodiment depicted in FIG. 1.
Figure 2B:
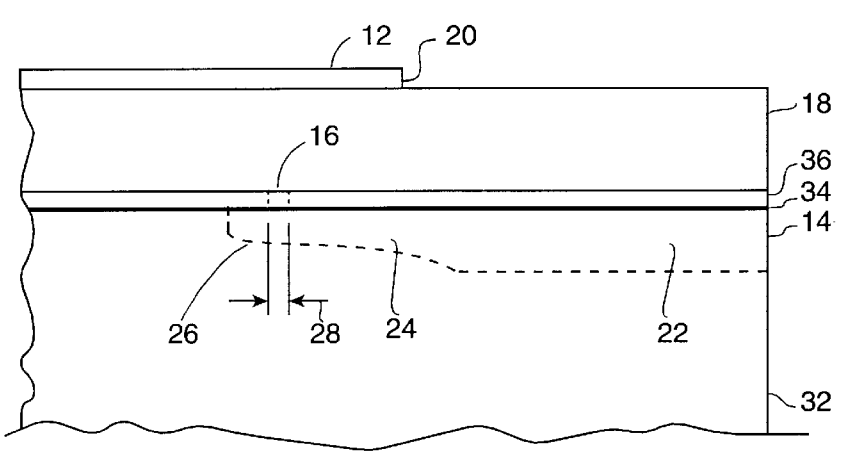
FIG. 2B is a side plan view of the embodiment depicted in FIG. 1.
Figure 2C:
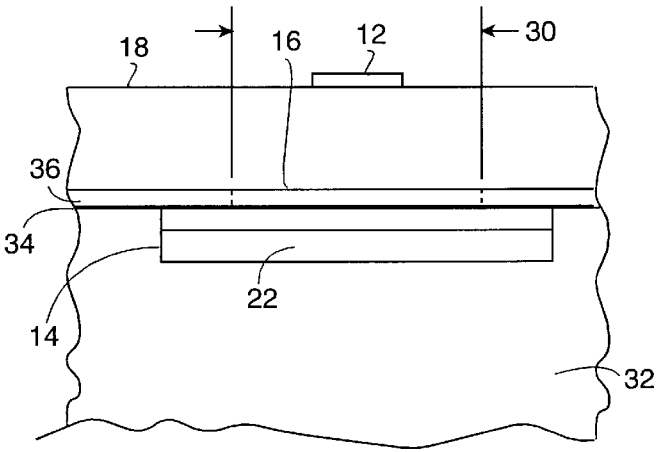
FIG. 2C is a front plan view of the embodiment depicted in FIG. 1.

Referring to FIG. 1 and to FIGS. 2A, 2B and 2C, microwave or millimeter wave energy (power) 10 flows along microstrip transmission line 12 and is desired to be coupled to and flow in waveguide 22, which for illustration purposes has depicted rectangular cross-section 14, such as for a WR-10 waveguide. (It should be noted, however, that in FIG. 1 and FIGS. 2A–2C flow 10 in waveguide 22 is shown at a sectioned edge 15 merely for illustration clarity purposes. Those skilled in the art can appreciate that waveguide 22 does not come to an abrupt stop at edge 15 but typically can extend along direction 17 as desired or required by the waveguide transmission line circuit.) An aperture 16 is etched through the backside microstrip board ground plane 36 on the opposite side of the board with respect to microstrip transmission line 12 (e.g., through the ground plane of an Arlon Isoclad 917 board, 0.005" thick, ½ oz Cu). An open circuit stub 20 proximate to aperture 16 is formed by an abrupt end of the microstrip transmission line. Aperture fields are excited as the power comes along the microstrip transmission line and encounters the aperture. A waveguide short circuit stub 26 is formed in the waveguide proximate to the aperture opening in the microstrip ground plane 36. Power, depicted schematically as direction arrow 19, couples through aperture 16 and into waveguide 22, with the open circuit and short circuit stubs being situated to effectively electrically cancel each other out as described in more detail below. The waveguide has a taper from the aperture area to the full-height standard waveguide (e.g., WR-10). Taper 24 is provided to help compensate for impedance mismatches in the aperture area. For example, the microstrip impedance is in the order of 50–80 ohms or so, while the standard waveguide impedance in the area of hundreds of ohms. The gradual taper is used to go from the high waveguide impedance to the lower microstrip impedance. The type of taper is not critical, e.g., it can be a linear taper or in a preferred embodiment a curved taper which minimizes the amount of curvature along the length of the taper. Of course, those skilled in the art can appreciate that the longer the taper, the better. However, the length of the taper is a tradeoff between the amount of space available for the taper and the amount of impedance mismatching which can occur. In the preferred embodiment, 0.2" long taper was chosen, with a gradual tapering from a full height narrow WR-10 wall of 0.050" to a reduced height narrow wall at the waveguide short circuit stub of 0.010". In the preferred embodiment a tapered curve was chosen based upon minimizing the mean square value of the second derivative of the waveguide height as a function of distance along the waveguide.

To provide a good impedance match, the length of the open circuit microstrip stub 20 and the length of the short circuit waveguide stub 26 become important. In the preferred embodiment, waveguide stub (back short) 26 is made smaller than a quarter wavelength at the center frequency in the device operating frequency range (e.g., at 80 GHz in the device operating frequency range of 75 GHz–85 GHz) and looks like an inductive reactance so that an inductance is provided at the junction. Open circuit microstrip stub 20 is similarly made smaller than a quarter wavelength at the center frequency in the device operating frequency range and looks capacitive. As such, the net inductance and capacitance of the stubs and other junction effects can be canceled out.

Width 28 of the aperture is not significant, other than it being narrow as compared to a wavelength. Length 30 of the slot is spaced equidistant about transmission line 12 and should be roughly half a wavelength at the center frequency in the device operating frequency range using the effective dielectric constant in the aperture which is typically the average of the dielectric material and air, since aperture slot 16 includes both air of the waveguide and dielectric of the board. Then, to effectively adjust the matching impedance, those skilled in the art can take into consideration the aperture slot reactance and dimensional characteristics and appropriately adjust the open circuit microstrip stub length and/or the waveguide back short length to minimize the return loss and insertion loss.

Figure 3:
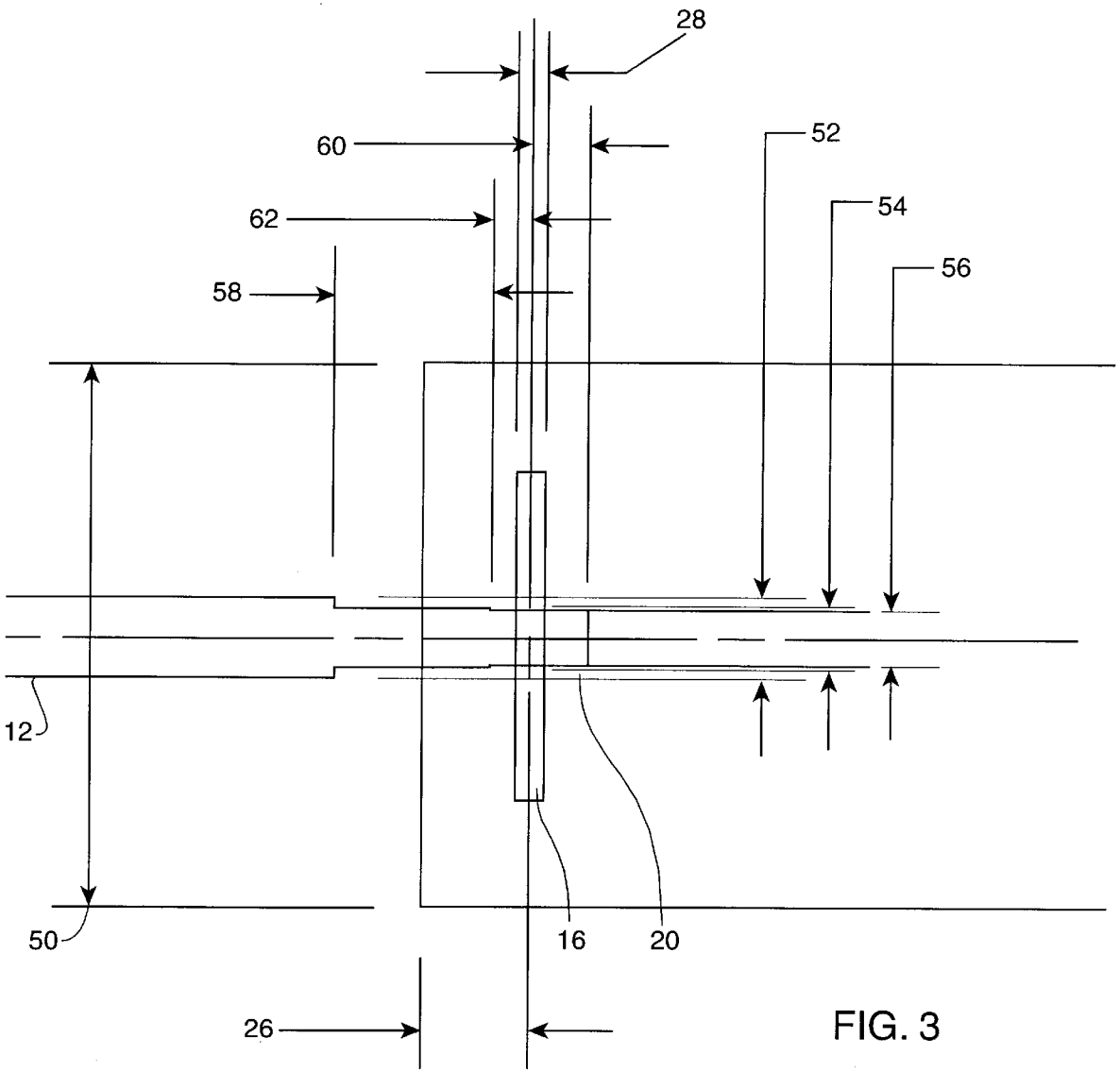
FIG. 3 shows schematic top plan view of various key dimensions of a preferred embodiment of the present invention.

Referring to FIG. 3, a schematic top plan view of various key dimensions of a working preferred embodiment of the present invention operating with WR-10 waveguide in a frequency range of 75–85 GHz is illustrated. Reference numerals consistent with aspects depicted in FIGS. 1 and 2A–2C are similarly numbered. Inner waveguide dimension 50 is 0.100". Microstrip 12 is located on an Arlon Isoclad 917, 0.005" thick, ½ oz Cu board and has an initial strip width 52 of 0.0148" and two transition steps 54 and 56 of 0.0105" and 0.010" respectively. Transition step 54 has a step length 58 of 0.029". Aperture width 28 is 0.005" and is located such that waveguide back short 26 is 0.020". Open circuit stub 20 has an end distance 60 from aperture 16 of 0.010" and has its junction distance 62 to the step 54/step 56 transition of 0.007".

Referring back to FIG. 1, to manufacture the transition, in a preferred embodiment, a block 32 is used to support microstrip circuit board 18. Block 32 is can be aluminum machined or cast to have groove(s) or channel(s) in it, which form two of the narrow walls of the waveguide along with a broad wall of the waveguide connecting the two narrow walls. WR-10 is the size of the waveguide to be formed in the preferred embodiment.

Microstrip board 18 is etched such that on one side there are microstrip transmission lines, while on the other side there are aperture(s) located in the ground plane 36 in relationship with the microstrip transmission line being coupled.

The etching process is standard wherein double-clad board is patterned on both sides such that the unwanted copper is etched away on both sides of the board.

A thin sheet of conductive adhesive 34, such as Ablestick (trademark) 5025E conductive epoxy, has appropriate openings cut into it. The adhesive is then laid onto the block area and the circuit board ground plane area is placed on top of the adhesive. Alignment pins may be used to align the adhesive and circuit board etchings with the grooves in the block. The alignment precision is kept on the order of +/−0.001". A temporary top plate, such as a hard plastic can be then placed on the circuit board to apply pressure and flatten the adhesive and provide a good bond between the circuit board ground plane (which will form the top of the waveguide when assembly is complete) and the block. The assembled unit is then heated in an oven to melt the conductive adhesive to form a good bond between the circuit board and the metal block and therefore good current conductivity. The Ablestick openings help prevent the adhesive adding additional loss to the top surface of the waveguide. The temporary top plate can then be removed and an appropriate permanent cover affixed to protect the microstrip circuits and any components (e.g., planar surface mounted Gunn diode oscillators) which may be mounted thereon.

Figure 5:
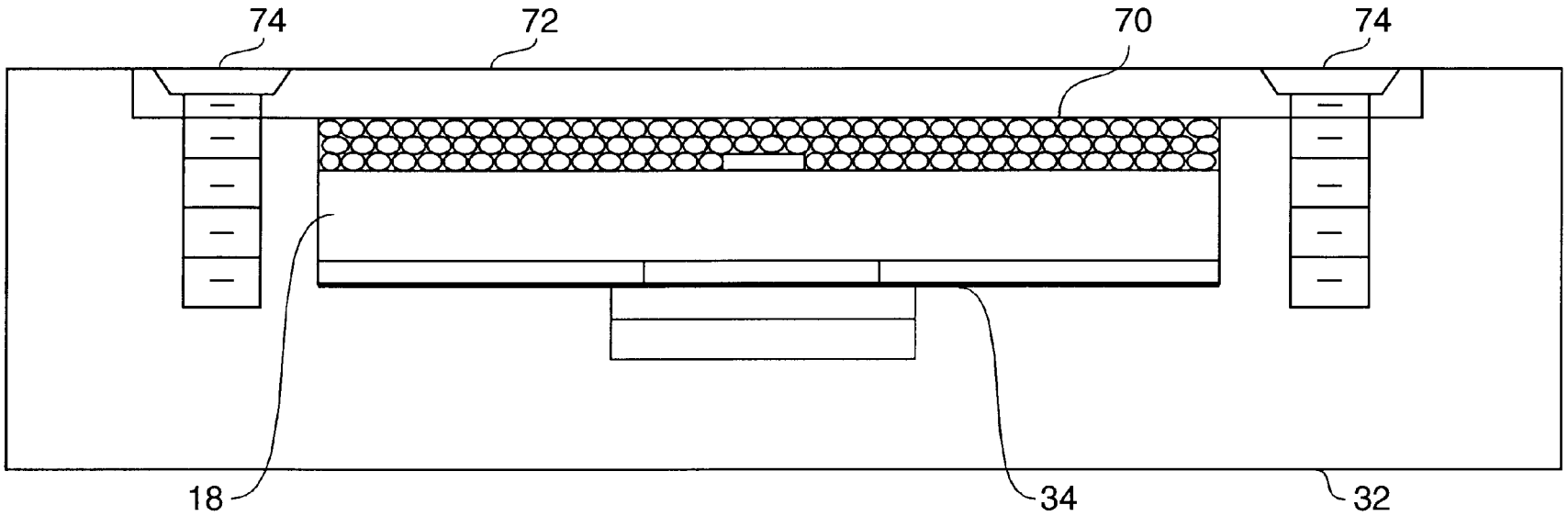
FIG. 5 shows a front plan view of an alternative embodiment.

In another embodiment, referring to FIG. 5, foam 70 (made of appropriate dielectric material for the microstrip transmission purposes) can be used between aluminum top plate 72 wherein screws 74 fasten top plate 72 with block 32, adhesive 34, etched circuit board 18, and foam 70 being sandwiched therebetween. In some applications, the use of foam is preferred in that it can be easily cut to accommodate chips and the like which are connected to the microstrip transmission line circuits.

Another advantage of the transition in accordance with the present invention is that the waveguide runs essentially in the same plane as the microstrip circuit, whereas in the prior art, typical transitions run such that the resulting transmission lines are perpendicular to each other. The present invention thus enables transmitted wave paths to be generally maintained in the same plane, particularly where there is not much vertical thickness space available.

Figure 4B:
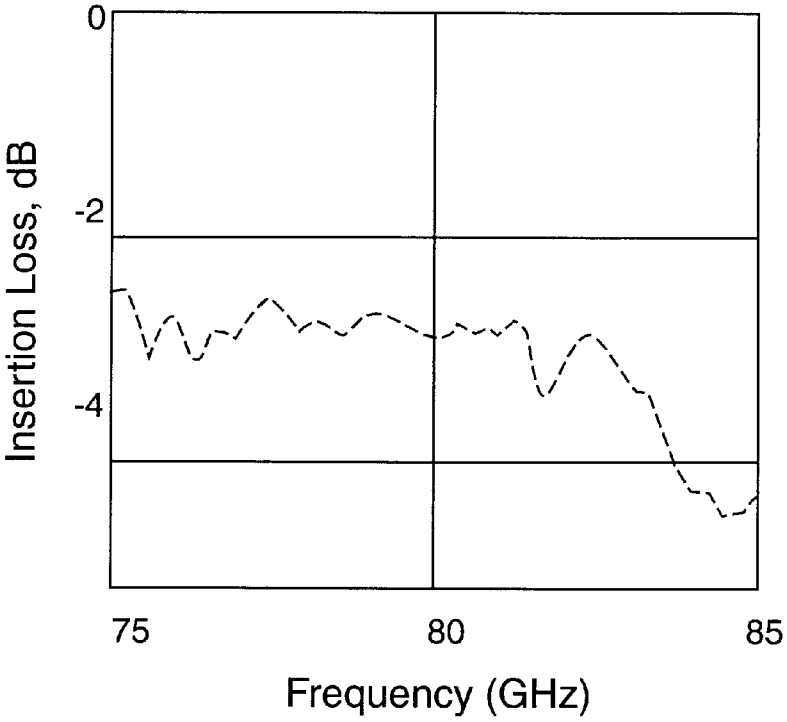
FIG. 4B is a graph showing measurements of Insertion Loss in dB vs. Frequency in GHz taken for a preferred embodiment of the invention.
Figure 4A:
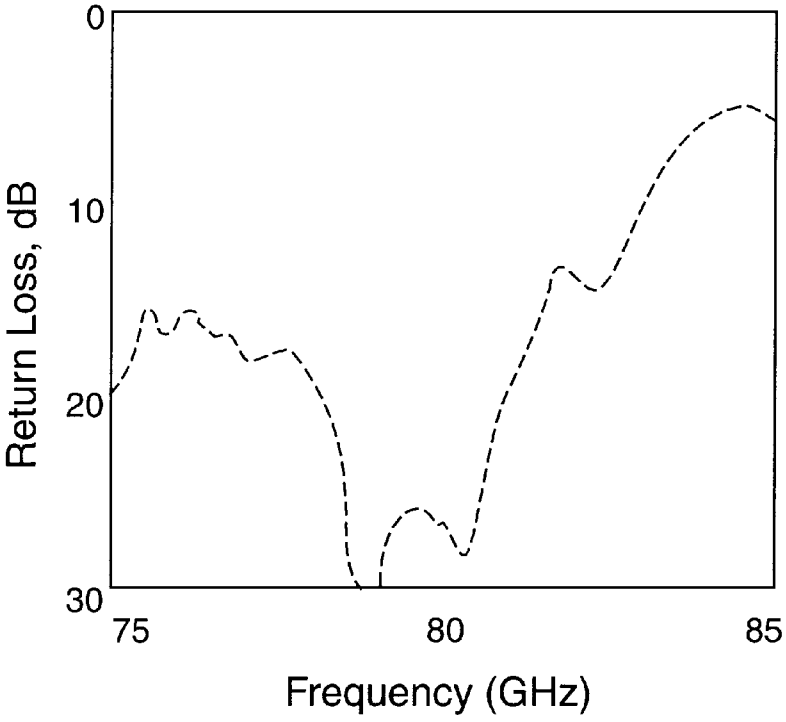
FIG. 4A is a graph showing measurements of Return Loss in dB vs. Frequency in GHz taken for a preferred embodiment of the invention.

Referring to FIG. 4A, there is shown a graph depicting measurements of Return Loss in dB vs. Frequency in GHz taken for two similar back to back (i.e., waveguide to microstrip to waveguide) transitions of a test device having the dimensions identified above with regard to FIG. 3.

Similarly, FIG. 4B is a graph showing measurements of Insertion Loss in dB vs. Frequency in GHz taken for the two back to back (i.e., waveguide to microstrip to waveguide) transitions for the test device having the dimensions identified above with regard to FIG. 3 and the Return Loss measurements of FIG. 4A.

Alternatives to the preferred embodiment will be apparent to those skilled in the art. For example, the aperture need not be perpendicular to the microstrip transmission line. However, in non-preferred embodiments not as much power will be coupled. The aperture could be offset from the conductor, providing the same general effect, but with a slightly different impedance transformation, which can be compensated for by the adjustments in the open circuit and back short stubs. However, maximum coupling is achieved when the microstrip transmission line is perpendicular to the aperture slot and the aperture slot is, in turn, perpendicular to the waveguide. Deviations from this configuration will reduce the amount of coupling and necessitate additional impedance matching.

What is claimed is:

1. A method for coupling a microstrip transmission line to a waveguide transmission line for microwave or millimeter-wave frequency range transmission, comprising the steps of:

providing a microstrip transmission line separated from a ground plane by a dielectric therebetween, the microstrip transmission line terminating at a microstrip transmission line open circuit end;

providing a waveguide channel having narrow dimension waveguide walls and a broad dimension base waveguide wall connected therebetween, the waveguide channel having a waveguide short circuit wall located along the channel, the narrow dimension waveguide walls being coupled with the ground plane to provide a broad dimension top waveguide wall for the waveguide transmission line; and locating an aperture transverse to the microstrip transmission line and passing through an aperture ground plane opening in the ground plane, the aperture being at an aperture location proximate to the microstrip transmission line open circuit end to provide a microstrip transmission line open circuit stub and being at an aperture location proximate to the waveguide short circuit wall to provide a waveguide transmission line short circuit stub.

2. The method for coupling a microstrip transmission line to a waveguide transmission line of claim 1, wherein the aperture location proximate to the microstrip transmission line open circuit end and the aperture location proximate to the waveguide short circuit wall are each less than a quarter-wavelength of an operating center frequency.

3. The method for coupling a microstrip transmission line to a waveguide transmission line of claim 2, wherein the waveguide transmission line is connected to the waveguide short circuit wall by a waveguide channel section having tapering narrow dimension waveguide walls for impedance matching the aperture ground plane opening with the waveguide transmission line.

4. The method for coupling a microstrip transmission line to a waveguide transmission line of claim 1, wherein the ground plane is bonded to the narrow dimension waveguide walls using a conductive adhesive.

5. The method for coupling a microstrip transmission line to a waveguide transmission line of claim 1, wherein the step of providing a microstrip transmission line separated from a ground plane by a dielectric therebetween includes the step of providing a microstrip board having a microstrip transmission line separated from a board ground plane by a board dielectric.

6. The method for coupling a microstrip transmission line to a waveguide transmission line of claim 1, further comprising the steps of forming the waveguide channel in a support block; and mounting the microstrip transmission line separated from a ground plane by a dielectric therebetween in the support block to provide the broad dimension top waveguide wall for the waveguide transmission line.

7. The method for coupling a microstrip transmission line to a waveguide transmission line of claim 6, further comprising the steps of:

mounting a foam dielectric onto the microstrip transmission line separated from a ground plane by a dielectric therebetween in the support block; and fastening a support block cover to the support block to sandwich the foam dielectric between the support block cover and the microstrip transmission line separated from a ground plane by a dielectric therebetween in the support block.

8. A microwave or millimeter-wave frequency range microstrip transmission line to waveguide transmission line transition, comprising:

a microstrip transmission line separated from a ground plane by a dielectric therebetween, the microstrip transmission line terminating at a microstrip transmission line open circuit end;

a waveguide channel having narrow dimension waveguide walls and a broad dimension base waveguide wall connected therebetween, the waveguide channel having a waveguide short circuit wall located along the channel, wherein the narrow dimension waveguide walls are coupled to the ground plane to provide a broad dimension top waveguide wall for the waveguide transmission line; and an aperture located transverse to the microstrip transmission line and passing through an aperture ground plane opening in the ground plane, the aperture being at an aperture location proximate to the microstrip transmission line open circuit end to provide a microstrip transmission line open circuit stub and being at an aperture location proximate to the waveguide short circuit wall to provide a waveguide transmission line short circuit stub.

9. The microwave or millimeter-wave frequency range microstrip transmission line to waveguide transmission line transition of claim 8, wherein the aperture location proximate to the microstrip transmission line open circuit end and the aperture location proximate to the waveguide short circuit wall are each less than a quarter-wavelength of an operating center frequency.

10. The microwave or millimeter-wave frequency range microstrip transmission line to waveguide transmission line transition of claim 9, wherein the waveguide transmission line is connected to the waveguide short circuit wall by a waveguide channel section having tapering narrow dimension waveguide walls for impedance matching the aperture ground plane opening with the waveguide transmission line.

11. The microwave or millimeter-wave frequency range microstrip transmission line to waveguide transmission line transition of claim 8, wherein the ground plane is bonded with the narrow dimension waveguide walls using a conductive adhesive.

12. The microwave or millimeter-wave frequency range microstrip transmission line to waveguide transmission line transition of claim 8, wherein the microstrip transmission line is on a microstrip board wherein the microstrip transmission line is separated from a board ground plane by a board dielectric.

13. The microwave or millimeter-wave frequency range microstrip transmission line to waveguide transmission line transition of claim 8, wherein the waveguide channel is formed in a support block and the microstrip transmission line separated from a ground plane by a dielectric therebetween is mounted in the support block to provide the broad dimension top waveguide wall for the waveguide transmission line.

14. The microwave or millimeter-wave frequency range microstrip transmission line to waveguide transmission line transition of claim 13, further comprising a foam dielectric mounted onto the microstrip transmission line separated from a ground plane by a dielectric therebetween in the support block and a support block cover fastened to the support block to sandwich the foam dielectric between the support block cover and the microstrip transmission line separated from a ground plane by a dielectric therebetween in the support block.

* * * * *